US005292628A

United States Patent [19]

Nittel et al.

[11] Patent Number: 5,292,628

[45] Date of Patent: Mar. 8, 1994

[54] PHOTOGRAPHIC SILVER HALIDE ELEMENT WITH GELATIN LAYER CONTAINING SILICA

[75] Inventors: Fritz Nittel; Heinz-Günther Auweiler; Manfred Peters; Hartmut Randolph, all of Leverkusen, Fed. Rep. of Germany

[73] Assignee: AGFA Gevaert AG, Leverkusen, Fed. Rep. of Germany

[21] Appl. No.: 53,456

[22] Filed: Apr. 27, 1993

[30] Foreign Application Priority Data

Apr. 28, 1992 [DE] Fed. Rep. of Germany ..... 4213869

[51] Int. Cl.[5] ..... G03C 1/76

[52] U.S. Cl. ..... 430/539; 430/523; 430/532; 430/533; 430/536; 430/527

[58] Field of Search ..... 430/272, 523, 527, 531, 430/533, 532, 536, 539

[56] References Cited

U.S. PATENT DOCUMENTS

| | | | |
|---|---|---|---|
| 4,232,117 | 11/1980 | Nadi et al. | 430/539 |
| 4,429,032 | 1/1984 | Matthe et al. | 430/539 |
| 4,895,792 | 1/1990 | Aizant et al. | 430/539 |
| 5,227,285 | 7/1993 | Hattori et al. | 430/539 |

*Primary Examiner*—Jack P. Brammer

*Attorney, Agent, or Firm*—Connolly and Hutz

[57] ABSTRACT

The adhesion of photographic layers to a film base that either has, on one or both sides, a surface consisting of a polyolefin layer that has been treated with a corona discharge, or consists of a polyester film provided with a (first) substrate layer is improved by an adhesive layer that is applied in the form of an oil-in-water emulsion consisting of 50 to 60 wt % of oil-formers and 40 to 50 wt % of a solid consisting of 50 to 80 wt % gelatin and 20 to 50 wt % colloidal $SiO_2$ together with the following layers to the surface of the film base.

5 Claims, No Drawings

PHOTOGRAPHIC SILVER HALIDE ELEMENT WITH GELATIN LAYER CONTAINING SILICA

This invention relates to a photographic material with a film base that either has, on one side or both, a surface consisting of a polyolefin layer or consists of a polyester film, and a special adhesive layer for this film base. The adhesive layer consists of 50 to 60 wt % of oil-formers and 40 to 50 wt % of a solid, that for its part consists of 50 to 80 wt % gelatin and 20 to 50 wt % $SiO_2$.

It is known to draw a gelatin layer (substrate layer) over polyethylene (PE)-coated papers. The layers are applied, after a corona discharge treatment, by means of a knife or roller application system with a wet coating weight of 3 to 8 g/m$^2$ and dried. The dry coating weight is between 100 and 400 mg/m$^2$. The coating with the gelatin-containing substrate layer is generally combined with the PE extrusion and the simultaneous application of an antistatic layer.

A separate application of the substrate layer would lead to considerable difficulties (soiling), since the pure PE layer running through the machine experiences powerful electrostatic charging and attracts dirt particles and dust present.

The substrate layer casting carried out together with the PE extrusion and corona discharge treatment is performed at high speed (about 100 to 130 m/min), so that at the low wet coating weight the applied substrate layer is so rapidly dried that the gelatin is present in pure sol form with a melting point of 8 to 12° C.

The application of further layers to this substrate layer leads to considerable difficulties. Thus, curtain-like structures can be observed on the smooth material that can be ascribed to an initial melting and slipping-off of the substrate layer. Furthermore in the processing of such a material a much impaired wet adhesion is observed. In practice this means that freshly cast substrate layers cannot be further coated directly after casting.

To improve the wet adhesion, the sol-gel rearrangement of the gelatin in the gelatin-containing substrate layer can be waited for. This is a reaction that requires a certain minimum time and a supply of moisture and is carried out either by rewinding at sufficiently high humidity (60 to 70% relative humidity) or by equilibration with the internal moisture of the raw material. The provision of an intermediate layer causes additional difficulty and expense.

But even after storage, the melting point of the substrate layer gelatin is still so low that, with further casting and vertical outflow of the web, another slippage of the layer that manifests itself in the appearance of curtain structures can occur.

In the case of the polyester film (PET), before the transverse stretching, a first substrate layer, based on a copolymer of vinylidene chloride, methyl acrylate and itaconic acid with addition of silica sol (GB-A-1 234 755 or U.S. patent application No. 3 649 336) is applied. Gelatin does not adhere to this first substrate layer, so that normally a second substrate layer is applied that contains, in addition to a little gelatin and latex, much silica sol. On recasting with gelatin-containing casting solutions—and then particularly when immediate hardeners are used—the wet adhesion of this layer is inadequate.

Faults in wet adhesion manifest themselves in the fact that when passing through developing machines, especially roll-transport machines, the edges of the casting become detached from the support.

To avoid these difficulties it has been obvious to attempt to subject the unsubstituted PE paper to a corona discharge treatment directly on the casting machine and then to apply the actual photographic layers (coating).

Here also, although on this occasion the drying process takes place more slowly than on the paper machine, it takes 8 to 10 days for sufficient wet adhesion to be reached if no immediate hardeners are used. This is not generally disturbing, since the hardening is complete only after a few days and in the interim the rearrangement of the sol into the gel form can continue to occur. This process becomes more problematic when using immediate hardeners, since then the sol/gel conditions existing immediately after the drying are fixed and subsequent rearrangements are no longer possible. In addition, amines are formed as by-products, that possibly block the hydrophilic centers arising on the PE surface as a result of the corona discharge treatment. As a result of this, the time for reaching a sufficient wet adhesion is sometimes extended to 3 weeks, and in some cases the wet adhesion remains permanently inadequate. In this way, with such long waiting periods, the advantages otherwise associated with immediate hardening could not be exploited.

With PET films a corona discharge treatment of the substrate layer applied initially before the transverse stretching is not effective. The wet adhesion remains inadequate.

The subject matter of the present invention is a photographic material that contains, disposed on a film base, a coating with at least one light-sensitive silver halide emulsion layer and optionally further light-sensitive and/or non-light-sensitive binder layers, whereby the film base

- either has, on one or both sides, a surface consisting of a polyolefin layer that has been exposed to a corona discharge treatment or
- consists of a polyester film provided with a (first) substrate layer, characterized in that, on the surface of the film base consisting of the polyolefin layer or of the first substrate layer and facing he coating, there is disposed a substratum adhesive layer, consisting of

- 50 to 60 wt % of high-boiling water-insoluble organic compounds (oil-formers) and
- 40 to 50 wt % of a solid consisting of
  - 50 to 80 wt % gelatin and
  - 20 to 50 wt % colloidal $SiO_2$, which is applied together with the photographic layers.

The film base of the photographic material according to the invention has at least one hydrophobic surface, to which first the adhesive layer according to the invention and subsequently the other layers of the coating are applied. The film base consists either of a support with polyolefin coating, e.g. of polyethylene-coated paper (PE paper), or of a polyester film that is provided with a first substrate layer. Correspondingly, the film base can be transparent or opaque. In the case of the PE paper, the PE coating has been exposed to a corona discharge treatment before the adhesive layer according to the invention is applied. In the case of the polyester film provided with a first substrate layer, the substrate layer contains for example an essentially hydrophobic copolymer that can contain carboxyl-group-containing monomer units, e.g. a copolymer with polymerized vinylidene chloride, methyl acrylate and itaconic acid units. The substrate layer can furthermore contain colloidal silicic acid.

As oil-formers, the compounds mentioned by Jelley et al. (U.S. patent application No. 2 322 027) can be applied, thus for example benzoates, phthalates, phosphates, adipates and the like, generally according to the definition there of organic compounds with a boiling point above 150° C. at normal pressure. Owing to their ready availability, low-viscosity esters are preferred, e.g.

A) Ethyl phthalate
B) Butyl phthalate
C) Benzyl butyl phthalate
D) Dioctyl phthalate
E) Di-n-nonyl phthalate
F) Di-i-nonyl phthalate
G) Benzyl phthalate
H) β-Butoxyethyl phthalate
I) Tricresyl phosphate
J) Trioctyl phosphate
K) Trichloroethyl phosphate The colloidal $SiO_2$ contained in the adhesive layer can for example be applied in the form of colloidal silicates, that are preferably so stabilized that they are stable in neutral and acid medium. Compounds that have proved suitable are those offered by Du Pont as Ludox ® types, e.g. Ludox ® AM and Ludox ® 130M.

The adhesive layer according to the invention, consisting essentially of oil-formers, gelatin and $SiO_2$, can be produced for example by casting the constituents mentioned in the form of an oil-in-water emulsion onto the film base mentioned, that is for example onto a corona-discharge-treated, otherwise substrate-layer-free PE paper, or onto a PET film provided with a first substrate layer.

The known water-soluble emulsifiers, such as for example sulphosuccinic acid diacetyl ester, dodecylbenzenesulphonate, the Na salt of tributylnaphthalic acid and the like can be applied as emulsifying aids for production of the oil-in-water emulsion. These emulsifiers are used e.g. in an amount of 0.5 to 2.0%, preferably ca. 1.0%, in relation to the amount of oil-former to be emulsified.

It has furthermore proved advantageous for 5 to 20%, preferably 8 to 12%, of the total amount of oil-formers to consist of hydrophilic, non-water-soluble compounds. The hydrophilic, non-water-soluble compounds, so-called "hydrophilic oil-formers", consist for example of long-chain or long-chain-substituted carboxylic acids, as described for example in DE-A 1 772 192, DE-A 2 042 659 and DE-A 2 049 689, preferably of succinic acid half-esters that are substituted with a long-chain aliphatic group. Suitable examples are e.g. the following.

1.
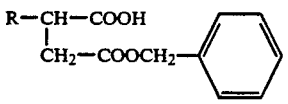

2.
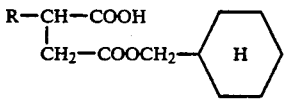

3.
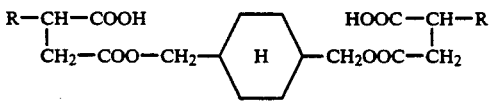

4.
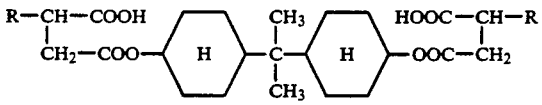

5.
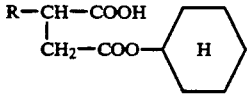

6.
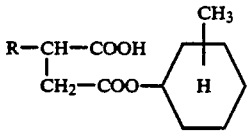

7.
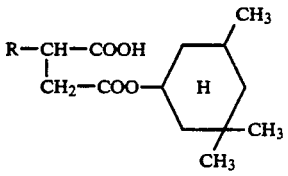

-continued
8.
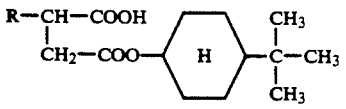
9.
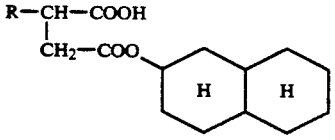
10.
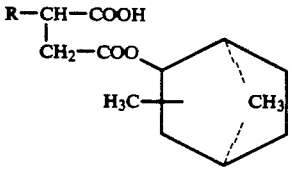
11.
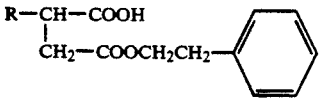
12.
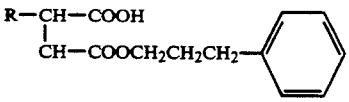
13.
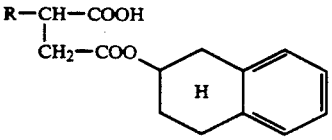
14.
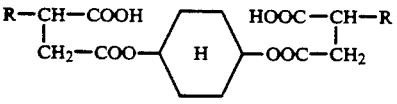
15.
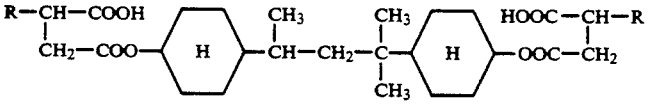
16.
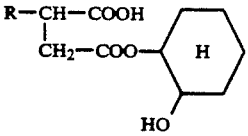
17.
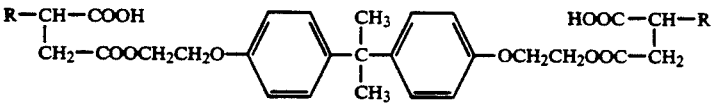
18.
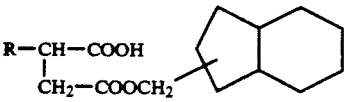
19.
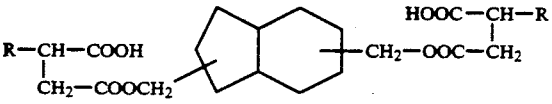

-continued

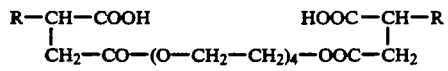

20.

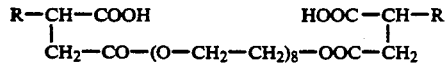

21.

In the given formulae 1 to 21, the symbol R stands for a fairly long aliphatic group with at least 8 carbon atoms. This is preferably one of the singly unsaturated aliphatic groups $-C_{12}H_{23}$, $-C_{15}H_{29}$ or $-C_{18}H_{35}$, whose formation can be explained by multiple addition of propylene.

Applied together with the adhesive layer according to the invention is the actual photographic coating, that consists of at least one light-sensitive silver halide emulsion layer and optionally further light-sensitive and/or non-light-sensitive binder layers.

The silver halide emulsion layers and the non-light-sensitive layers are all on the same side of the film base.

Essential constituents of the photographic emulsion layers are binders, silver halide particles and (in the case of color-photographic materials) dye couplers.

Gelatin is preferably used as a binder. It can, however, be replaced completely or partly by other synthetic, semisynthetic or even naturally occurring polymers. Synthetic gelatin substitutes are for example polyvinyl alcohol, poly-n-vinylpyrrolidone, polyacrylamides, polyacrylic acid and their derivatives, especially their copolymers.

Naturally occurring gelatin substitutes are for example other proteins such as albumin or casein, cellulose, sugar, starch or alginates. Semisynthetic gelatin substitutes are usually modified natural products. Examples of these are cellulose derivatives such as hydroxyalkylcellulose carboxymethylcellulose and phthalylcellulose as well as gelatin derivatives that have been obtained by reaction with alkylating or acylating agents or by grafting of polymerizable monomers.

The binders should have available a sufficient quantity of functional groups so that by reaction with suitable hardeners, sufficiently resistant layers can be produced. Such functional groups are in particular amino groups but also carboxyl groups, hydroxyl groups and active methylene groups.

The silver halide present as light-sensitive constituent in the photographic material can contain chloride, bromide, iodide or mixtures thereof as the halide. For example, the halide content of at least one layer can consist of 0 to 15 mol % iodide, 0 to 100 mol % chloride and 0 to 100 mol % bromide. In the case of color negative and color reversal films, silver bromide iodide emulsions are usually used, and in the case of color negative and color reversal paper, silver chloride bromide emulsions with a high proportion of chloride up to pure silver chloride emulsions are usually used.

The silver halide is mainly in the form of compact crystals that are e.g. regular cubic or octahedral or can have transitional forms. Preferably, however, platelike crystals can also be present, whose average ratio of diameter to thickness is preferably at least 5:1, the diameter of a particle being defined as the diameter of a circle with an area corresponding to the projected area of the particle. The layers can, however, also have platy silver halide crystals in which the ratio of diameter to thickness is considerably greater than 5:1, e.g. 12:1 to 30:1.

The silver halide particles can also have a multiple laminated particle structure, in the simplest case with an inner and an outer particle zone (core/shell), wherein the halide composition and/or other modifications, such as e.g. doping of the individual zones of the particle, are different. The average particle size of the emulsions is preferably between 0.2 μm and 2.0 μm, and the particle size distribution can be both homo- and heterodisperse. A homodisperse particle size distribution means that 95% of the particles do not deviate by more than ±30% from the mean particle size. The emulsions can also contain, apart from the silver halide, organic silver salts, e.g. silver benzotriazolate or silver behenate.

Two or several kinds of silver halide emulsions, that are separately produced, can be used as a mixture.

The silver halide emulsions can be chemically and/or spectrally sensitized in the usual way: they can be stabilized by suitable additives in known manner against sensitivity loss, against fogging and also with regard to the latent image; and the silver halide emulsion layers, like other non-light-sensitive binder layers also, can be hardened in the usual way with known hardeners.

Suitable hardeners are e.g. formaldehyde, glutaraldehyde and similar aldehydic compounds, diacetyl, cyclopentadione and similar ketonic compounds, bis(2-chloroethylurea), 2-hydroxy-4,6-dichloro-1,3,5-triazine and other compounds containing reactive halogen (U.S. patent application No. 3 288 775, U.S. patent application No. 2 732 303, GB-A-974 723 and GB-A-1 167 207), divinylsulphone compounds, 5-acetyl-1,3-diacryloylhexahydro-1,3,5-triazine and other compounds containing a reactive olefinic bond (U.S. patent application No. 3 635 718, U.S. patent application No. 3 232 763 and GB-A-994 869); N-hydroxymtthylphthalimide and other N-methylol compounds (U.S. patent application No. 2 732 316 and U.S. patent application No. 2 586 168); isocyanates (U.S. patent application No. 3 103 437); aziridine compounds (U.S. patent application No. 3 017 280 and U.S. patent application No. 2 983 611); acid derivatives (U.S. patent application No. 2 725 294 and U.S. patent application No. 2 725 295); compounds of the carbodiimide type (U.S. patent application No. 3 100 704); carbamoylpyridinium salts (DE-A-22 25 230 and DE-A-24 39 551); carbamoyloxypyridinium compounds (DE-A-24 08 814); compounds with a phosphorus-halogen bond (JP-A-113 929/83); N-carbonyloximide compounds (Jp-A-43353/81); N-sulphonyloximido compounds (U.S. patent application No. 4 111 926), dihydroquinoline compounds (U.S. patent application No. 4 013 468), 2-sulphonyloxypyridinium salts (JP-A-110 762/81), formamidinium salts (EP-A-0 162 308), compounds with two or more N-acyloximino groups (U.S. patent application No. 4 052 373)), epoxy compounds (U.S. patent application No. 3 091 537), compounds of the isoxazole type (U.S. patent application No. 3 321 313 and U.S. patent application No. 3 543 292); halogenocarboxyaldehydes, such as mucochloric acid; dioxane derivatives, such as dihydroxydioxane and dichlorodioxane; and inorganic hardeners such as chrome alum and zirconium sulphate.

The hardening can be carried out in a known manner by adding the hardener to the casting solution for the layer to be hardened or by overcoating the layer to be hardened with a casting containing a hardener capable of diffusion.

Among the classes listed there are slow-acting and rapid-acting hardeners, as well as so-called immediate hardeners, which are particularly advantageous. Immediate hardeners are understood to be compounds that so crosslink suitable binders that immediately after casting or at the latest after 24 hours, preferably at the latest after 8 hours, the hardening is so complete that no further change of the sensitometry and the swelling of the layer system determined by the crosslinking reaction occurs. Swelling is understood to be the difference between wet layer thickness and dry layer thickness during the aqueous processing of the film (Photogr. Sci., Eng. 8 (1964), 275; Photogr. Sci. Eng. (1972), 449).

These hardeners reacting very rapidly with gelatin are e.g. carbamoylpyridinium salts that are capable of reacting with free carboxyl groups of the gelatin, so that the latter react with free amino groups of the gelatin with formation of peptide bonds and crosslinking of the gelatin.

Suitable examples of immediate hardeners are e.g. compounds of the general formulae

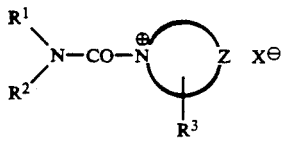

(a)

wherein $R^1$ represents alkyl, aryl or aralkyl, $R^2$ has the same meaning as $R^1$ or signifies alkylene, arylene, aralkylene or alkaralkylene, the second bond being linked with a group of the formula

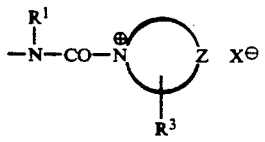

or $R^1$ and $R^2$ together represent the atoms required for completion of an optionally substituted heterocyclic ring, for example a piperidine, piperazine or morpholine ring, in which the ring can be substituted e.g. by $C_1$–$C_3$ alkyl or halogen, $R^3$ represents hydrogen, alkyl, aryl, alkoxy, $—NR^4—COR^5$, $—(CH_2)_m—NR^8R^9$, $—(CH_2)_n—CONR^{13}R^{14}$ or $$—(CH_2)_p—\underset{\underset{R^{15}}{|}}{CH}—Y—R^{16}$$

or a binding link or a direct bond to a polymer chain, wherein $R^4$, $R^6$, $R^7$, $R^9$, $R^{14}$, $R^{15}$, $R^{17}$, $R^{18}$ and $R^{19}$ represent hydrogen or $C_1$–$C_4$ alkyl, $R^5$ represents hydrogen, $C_1$–$C_4$ alkyl or $NR^6R^7$, $R^8$ represents $—COR^{10}$, $R^{10}$ represents $NR^{11}R^{12}$, $R^{11}$ represents $C_1$–$C_4$ alkyl or aryl, especially phenyl, $R^{12}$ represents hydrogen, $C_1$–$C_4$ alkyl or aryl, especially phenyl, $R^{13}$ represents hydrogen, $C_1$–$C_4$ alkyl or aryl, especially phenyl, $R^{16}$ represents hydrogen, $C_1$–$C_4$ alkyl, $COR^{18}$ or $CONHR^{19}$, m represents a number from 1 to 3, n represents a number from 0 to 3, and p represents a number from 2 to 3, and Y represents O or $NR^{17}$ or $R^{13}$ and $R^{14}$ together represent the atoms required for completion of an optionally substituted heterocyclic ring, for example a piperidine, piperazine or morpholine ring, in which the ring can be substituted by $C_1$–$C_3$ alkyl or halogen, Z represents the C atoms required for completion of a 5- or 6-membered aromatic heterocyclic ring, optionally with fused benzene ring, and $X^{\ominus}$ represents an anion, which is inapplicable if an anionic group is already linked to the rest of the molecule; and

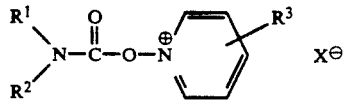

(b)

wherein $R^1$, $R^2$, $R^3$ and $X^{\ominus}$ have the meaning indicated for formula (a).

There are hardeners capable of diffusion that harden all layers within a layer system in the same way. But there are also low-molecular and high-molecular hardeners whose action is limited to certain layers and which do not diffuse. With them, individual layers, e.g. the anti-abrasion layer, can be particularly strongly crosslinked. This is important if the silver halide layer is not much hardened for the sake of increasing the silver's covering power and the mechanical properties must be improved with the anti-abrasion layer (EP-A 0 114 699).

The film base provided with the adhesive layer according to the invention is equally suitable for black-and-white materials (e.g. for the production of silver images) and for color-photographic mat<rials. The latter usually have several light-sensitive silver halide emulsion layers with different spectral sensitivity and corresponding dye couplers. Layers of different spectral sensitivity are usually separated by intermediate layers.

As an example, a layer arrangement of a color-photographic material according to the invention contains, in the indicated sequence, on a film base of PE paper that has an adhesive layer according to the invention:

1) Substrate layer,
2) Blue-sensitive layer,
3) Intermediate layer,
4) Green-sensitive layer,
5) Intermediate layer,
6) Red-sensitive layer,
7) Anti-abrasion layer, wherein the anti-abrasion layer can also be a double layer.

The photographic material can moreover contain other additives, e.g. UV-light-absorbing compounds, whitening agents, spreaders, filter dyes, formalin traps, light stabilizers, antioxidants, $D_{Min}$ dyes, additives for improving the stabilization of dyes, couplers and whites as well as for reducing the chemical fog, plasticizers (latices), biocides and others.

UV-light-absorbing compounds are intended on the one hand to protect the image dyes from bleaching by UV-rich daylight and on the other hand as filter dyes to absorb the UV light in the daylight during the exposure and so improve the color reproduction of a film. Usually, compounds of different structure are applied for the two tasks. Examples are aryl-substituted benzotriazole compounds (U.S. patent application No. 3 533 794), 4-thiazolidone compounds (U.S. patent application Nos. 3 314 794 and 3 352 681), benzophenone compounds JP-A-2784/71), cinnamate ester compounds (U.S. patent application No. 3 705 805 and 3 707 375), butadiene compounds (U.S. patent application No. 4 045 229) or benzoxazole compounds (U.S. patent application No. 3 700 455).

Color-photographic materials are usually processed by developing, bleaching, fixing and washing or by developing, bleaching, fixing and stabilizing without subsequent washing, wherein bleaching and fixing can be combined to a single processing step. Any compound can be used as a color developer compound that is capable of reacting in the form of its oxidation product with dye couplers to azomethine or indophenol dyes. Suitable color developer compounds are aromatic compounds of the p-phenylenediamine type containing at least one primary amino group, for example N,N-dialkyl-p-phenylenediamines such as N,N-diethyl-p-phenylenediamine, 1-(N-ethyl-N-methanesulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful color developers are described for example in J. Amer. Chem. Soc. 73, 3106 (1951) and G. Haist, Modern Photographic Processing, 1979, John Wiley and Sons, New York, pages 545 ff.

The color development can be followed by an acid stop bath or a washing.

Usually, immediately after the color development, the material is bleached and fixed. As bleaching agents, e.g. Fe(III) salts and Fe(III) complex salts such as ferricyanides, dichromates and water-soluble cobalt complexes can be used. Especially preferred are iron(III) complexes of aminopolycarboxylic acids, especially e.g. of ethylenediaminetetraacetic acid, propylenediaminetetraacetic acid, diethylenetriaminepentaacetic acid, nitrilotriacetic acid, iminodiacetic acid, N-hydroxyethylethylenediaminetriacetic acid, alkyliminodicarboxylic acids and corresponding phosphonic acids. Furthermore, persulphates and peroxides, e.g. hydrogen peroxide, are suitable as bleaching agents.

The bleaching-fixing bath or fixing bath is usually followed by a washing, that is operated as a countercurrent washing or consists of several tanks with their own water supply.

The washing can be completely replaced by a stabilizing bath, that is usually operated in countercurrent.

If for the production of the adhesive layer according to the invention an oil-in-water emulsion of the composition described below is used as the substratum layer of a photographic material, a good wet adhesion is obtained even immediately after casting, and after 12 h storage the adhesion is optimal. In contrast thereto, substratum layers that consist of gelatin or oil-in-water emulsions having low oil-former content reach these values only after 6 to 8 days at the earliest; when using immediate hardeners, in many cases the wet adhesion is not satisfactory even after 3 weeks.

On PET film with a first substrate layer, no adhesion at all is achieved with gelatin or reduced oil-former content.

The mode of action of the adhesive layers according to the invention is presumably based on the high oil-former content.

Thus for example the oil-in-water emulsions are stable during production, storage and digestion but, on drying, oil-formers and emulsifier separate at the interface, which causes the improvement in adhesion. Oil-in-water emulsions that, because of fairly low oil-former content or lack of silicate, do not have this exudation, show no improvement (see the Examples).

EXAMPLES

Instruction 1 a) Production of an oil-in-water emulsion to 5 1 of a 10% gelatin solution there are added
- 3.3 1 water and
- 1.67 kg of a 30% uolution of a colloidal silicon dioxide (Ludox ®AM), and at 40° C. the following solution is emulsified in with an intensive stirrer:
- 2 kg ethyl acetate
- 1 kg Compound F (oil-former)
- 0.01 kg sulphosuccinic acid dioctyl ester (emulsifier)
- 0.2 kg of a 50% solution (in diethyl carbonate) of the auxiliary emulsifier, octadecenylsuccinic acid monobenzyl ester (Compound of Formula 1; $R=-C_{18}H_{35}$)

After the emulsification, the auxiliary solvent is removed in an evaporator.

b) Production of the casting solution

- 72.67 1 desalinated water
- 26.33 kg of the oil-in-water emulsion produced as above
- 1 kg sulphosuccinic acid dioctyl ester (4%)
- Wet coating weight as substratum layer in cascade: 11 g Dry coating weight: 500 mg/m$^2$.

By varying the amount of water for a given wet coating weight, the dry coating weight can be adjusted between 200 and 1,000 mg/m$^2$.

To a corona-discharge-treated PE support or a PET film, the following layers are applied in the indicated sequence (Material 1). The quantities quoted each relate to 1 m$^2$. For the silver halide coating the corresponding amounts of $AgNO_3$ are given.

Layer 1 (substrate layer)
- 0.3 g gelatin

Layer 2 (blue-sensitive layer) blue-sensitive silver halide emulsion (99.5 mol % chloride, 0.5 mol % bromide; mean particle diameter 0.8 μm) from 0.63 g $AgNO_3$ with
- 1.38 g gelatin
- 0.95 g yellow coupler
- 0.29 g tricresyl phosphate (TCP)

Layer 3 (anti-abrasion layer)
- 1.1 g gelatin
- 0.06 g 2,5-dioctylhydroquinone
- 0.06 g dibutyl phthalate (DBP)

Layer 4 (green-sensitive layer)

green-sensitized silver halide emulsion (99.5 mol % chloride, 0.5 mol % bromide; mean particle diameter 0.6 μm) from 0.45 g $AgNO_3$ with 1.08 g gelatin 0.45 g magenta coupler 0.08 g 2,5-dioctylhydroquinone 0.5 g dibutyl phthalate 0.4 g tricresyl phosphate Layer 5 (UV protective layer)

1.15 g gelatin 0.6 g UV absorber of the formula

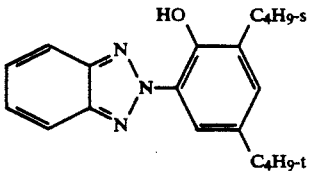

0.045 g 2,5-dioctylhydroquinone 0.3 g tricresyl phosphate

Layer 6 (red-sensitive layer) red-sensitized silver halide emulsion (99.5 mol % chloride, 0.5 mol % bromide; mean particle diameter 0.5 μm) from 0.3 g $AgNO_3$ with 0.75 gelatin 0.36 g cyan coupler 0.36 g tricresyl phosphate Layer 7 (UV protective layer)

0.35 g gelatin 0.15 g UV absorber as in layer 5

0.075 g tricresyl phosphate

Layer 8 (anti-abrasion layer)

0.9 g gelatin 0.3 g hardener:

carbamoylpyridinium salt,

CAS Reg. No. 65411-60-1

The following compounds were used as dye couplers:

Yellow coupler:

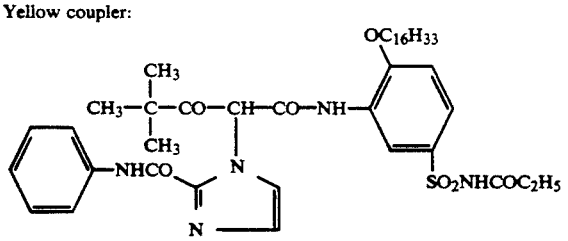

Magenta coupler:

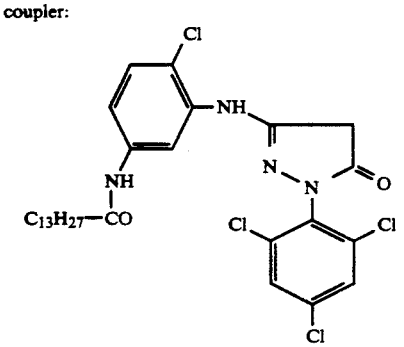

Cyan coupler:

-continued

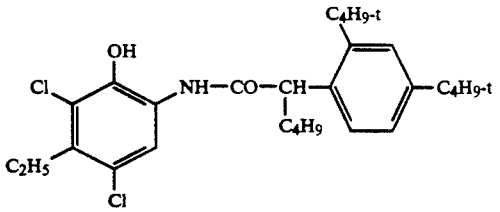

Further materials 2 to 8 were produced similarly, using the same film base material and the same coating (layers 2 to 8), only the composition of the adhesive layer being varied: i.e. instead of layer 1 an adhesive layer according to the invention was used, being applied together with layers 2–8 as a layer package (cascade or curtain caster) to the film base (production of the adhesive layer analogously to Instruction 1).

Material 2: Compounds B and 1 (R=—$C_{18}H_{35}$)

Material 3: Compounds C and 1 (R=—$C_{18}H_{35}$)

Material 4: Compounds F and 2 (R=—$C_{18}H_{35}$)

Material 5: Compounds F and 6 (R=—$C_{18}H_{35}$)

Material 6: application of gelatin as substratum layer

Material 7: reduction of the amounts of oil-former (Compound F), emulsifier and auxiliary emulsifier (Compound 1) to one-half of the values indicated in Instruction 1

Material 8: replacement of the amount of silicic acid in Instruction 1 by the same amount of gelatin.

The further materials 9 to 16 were produced correspondingly with the same coating (Layers 1 to 8) and using a non-corona-discharge-treated PET film with inline substrate (vinylidene chloride-methyl acrylate-itaconic acid copolymer/silica sol) as film base, only the adhesive layer being varied as follows:

Material 9: adhesive layer as in Example 1

Material 10: adhesive layer as in Example 2

Material 11: adhesive layer as in Example 3

Material 12: adhesive layer as in Example 4

Material 13: adhesive layer as in Example 5

Material 14: adhesive layer as in Example 6

Material 15: adhesive layer as in Example 7

Material 16: adhesive layer as in Example 8

EVALUATION OF THE TESTS

The oil-in-water emulsions are drawn, as described above, as substratum layer together with the photographic layers on corona-discharge-treated PE paper and hardened with immediate hardener.

The wet adhesion after various storage times was tested as follows: the material was immersed for 3 min in color developer at 40° C. and then briefly rinsed with water. With a plastics stick in the shape of a pencil having a point of 1 mm diameter, 2 crosses are made so that the scratches penetrate to the support. A rubber stopper (3 to 4 cm in diameter) is now rubbed vigorously over the places with the crosses, when the following can occur:

| | |
|---|---|
| a) no or insignificant widening of the scratches | score 1 |
| b) widening of the scratches by a factor of 3 or 4 | score 3 |
| c) with light pressure, the layer comes away in flat cakes | score 5 |

RESULTS

| Material | Score after 1 h | 6 h | 12 h | 7 days | 21 days |
|---|---|---|---|---|---|
| A/PE paper, corona-discharge-treated, immediate hardening | | | | | |
| 1 | 3 | 1 | 1 | 1 | 1 |
| 2 | 3 | 1 | 1 | 1 | 1 |
| 3 | 3 | 1 | 1 | 1 | 1 |
| 4 | 3 | 1 | 1 | 1 | 1 |
| 6 | 5 | 5 | 5 | 5 | 3 |
| 8 | 5 | 5 | 5 | 5 | 3 |
| PET film, immediate hardening | | | | | |
| 9 | 1 | 1 | 1 | 1 | 1 |
| 10 | 1 | 1 | 1 | 1 | 1 |
| 11 | 1 | 1 | 1 | 1 | 1 |
| 12 | 1 | 1 | 1 | 1 | 1 |
| 14 | 5 | 5 | 5 | 5 | 5 |
| 15 | 5 | 5 | 5 | 5 | 5 |
| 16 | 5 | 5 | 5 | 5 | 5 |

As tests 7 and 8 show, both the high oil-former content and the presence of colloidal silicic acid is a condition for adhesion improvement.

We claim:

1. Photographic material that contains, disposed on a film base, a coating with at least one light-sensitive silver halide emulsion layer and optionally further light-sensitive and/or non-light-sensitive binder layers, wherein the film base either has, on one or both sides, a surface consisting of a polyolefin layer that has been treated with a corona discharge, or consists of a polyester film provided with a (first) substrate layer, characterized in that there is disposed on the surface of the film base facing the coating and consisting of the polyolefin layer or the first substrate layer a substratum adhesive layer consisting of 50 to 60 wt % of high-boiling water-insoluble organic compounds (oil-formers) and 40 to 50 wt % of a solid consisting of 50 to 80 wt % gelatin and 20 to 50 wt % colloidal $SiO_2$.

2. A material according to claim 1, characterized in that of the total quantity of oil-formers in the adhesive layer, 5 to 20% consists of hydrophilic, non-water-soluble organic compounds that contain at least one group solubilizing in the alkaline range.

3. A material according to claim 2, characterized in that the adhesive layer contains, as hydrophilic, non-water-soluble organic compounds, succinic acid half-esters that are substituted with a long-chain ($C_{12}$–$C_{18}$) aliphatic group.

4. A material according to claim 1, characterized in that the adhesive layer contains esters of phthalic acid and/or of phosphoric acid as oil-formers.

5. A material according to claim 1, characterized in that the adhesive layer has been applied to the film base in the form of an oil-in-water emulsion consisting of 50 to 60 wt % of high-boiling water-insoluble organic compounds and 40 to 50 wt % of a solid consisting of 50 to 80 wt % gelatin 20 to 50 wt % colloidal $SiO_2$ as substratum adhesive layer together with the coating.

* * * * *